United States Patent [19]

Stevens

[11] 4,274,129

[45] Jun. 16, 1981

[54] NOVELTY PUMP LAMP

[75] Inventor: Garland A. Stevens, Silverhill, Ala.

[73] Assignee: Huff-Ste., Inc., Silverhill, Ala.

[21] Appl. No.: 95,659

[22] Filed: Nov. 19, 1979

[51] Int. Cl.[3] ..... F21V 33/00

[52] U.S. Cl. ..... 362/109; 362/253; 362/399

[58] Field of Search ..... 362/109, 253, 399

[56] References Cited

U.S. PATENT DOCUMENTS

| | | | |
|---|---|---|---|
| 2,014,217 | 9/1935 | Williamson | 362/395 |
| 2,638,530 | 5/1953 | Duda | 362/395 |

*Primary Examiner*—Stephen J. Lechert, Jr.

*Attorney, Agent, or Firm*—B. B. Olive

[57] ABSTRACT

A novelty lamp utilizes an old-fashioned hand-type water pump to support the lamp and shade and, in a preferred form, has a three-way ratchet switch arranged so that raising and lowering of the pump handle effects energizing and lighting of the lamp in one of three wattages.

4 Claims, 2 Drawing Figures

NOVELTY PUMP LAMP

BACKGROUND OF THE INVENTION

1. Field of the Invention

This invention relates to lamps and particularly to novelty lamps, the body of which is formed of some other device.

2. Description of the Prior Art

It has long been known to modify various devices so that they form the body of a lamp. However, it is believed that the prior art does not teach a lamp formed from an old-fashioned hand-type water pump and having a switch operated by up and down movement of the pump handle to simulate the old-fashioned pump operation.

SUMMARY OF THE INVENTION

A novelty lamp utilizes an old-fashioned hand-type water pump with the interior bellows portion removed and a three-way rachet-type switch installed in the base so that the pump rod can contact the switch actuator. Support means are secured to the pump body to provide lamp shade, socket and light bulb support. Sequential raising and lowering of the pump handle causes the pump rod to operate the switch so as to turn the lamp on, light the lamp in one of its three wattages in sequence and then turn the lamp off. A single wattage lamp arrangement is also disclosed.

DESCRIPTION OF THE PREFERRED EMBODIMENT

Figure 1:
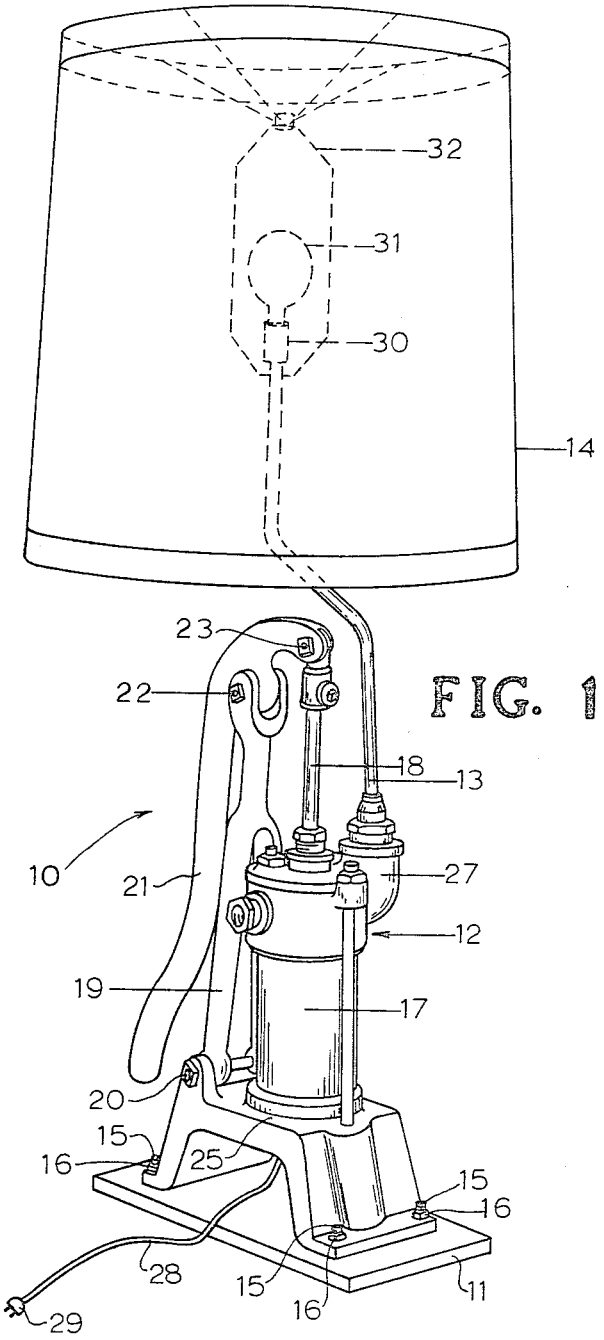
FIG. 1 is a perspective view of the novelty pump lamp of the invention with the light bulb, socket and shade support shown in dashed lines.
Figure 2:
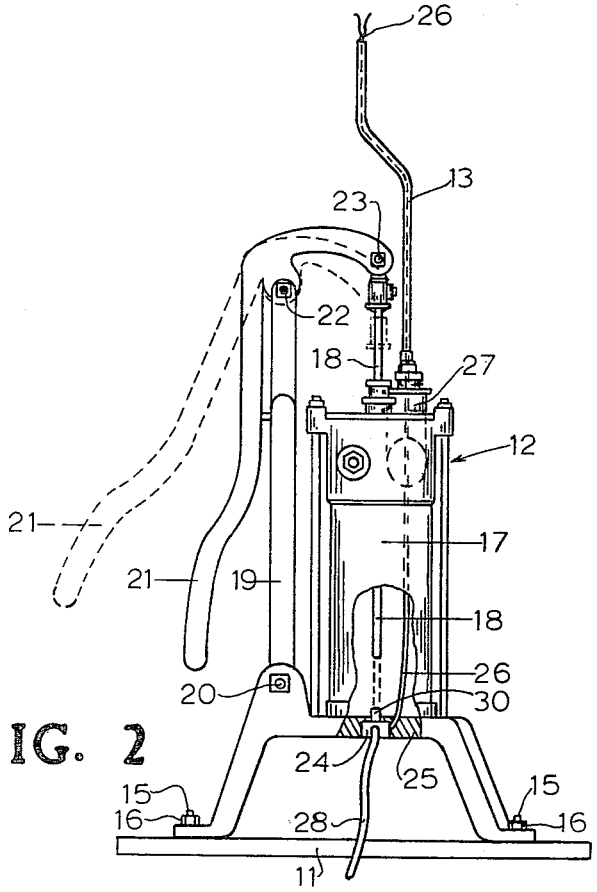
FIG. 2 is a side elevation view with a portion of the pump body broken away to illustrate the three-way push switch and with the lamp shade, socket and light bulb holding apparatus broken off.

Referring to FIG. 1, the preferred embodiment of novelty pump lamp 10 comprises a lamp base 11, a discarded or otherwise simulated old-fashioned hand pump 12, support apparatus 13, and lamp shade 14. A conventional bulb socket 30, three-way light bulb 31, e.g., 50 watt, 100 watt, 150 watt, and shade support 32 are used. Pump 12 is bolted to base 11 by bolts 15 and nuts 16. Pump cylinder 17 has the usual interior mechanism, i.e., bellows, et cetera, removed and only pump rod 18 moves vertically in cylinder 17. Linkage 19 is pivotal at its lower end at 20. The upper end of linkage 19 mounts pump handle 21 by means of pivot 22. Handle 21 is also pivotally secured to the upper end of pump rod 18 by pivot 23. As seen in FIG. 2, raising of handle 21 to the dashed line position causes pump rod 18 to be lowered. A three-way ratchet-type switch 24 is fixedly secured in the bottom 25 of pump 12. Appropriate wiring 26 passes from switch 24 upward within cylinder 16 and out pump outlet 27. Wiring 26 then passes through support apparatus 13 and is wired into the conventional light socket 30. Additional wiring 28 passes from the three-way ratchet switch 24 and is in the form of a supply cord which by means of plug 29 plugs into a wall outlet to supply electrical power to switch 24.

As illustrated in FIG. 2, the solid line or rest position of handle 21 causes rod 18 to be raised and in turn out of contact with actuator button 30 of ratchet 24. The dashed line raised or switching position of handle 21 causes rod 18 to be moved downward and to depress button 30 of switch 24.

The actuation or ratcheting of switch 24 is thus accomplished by sequential pressing and releasing of actuator button 30. Ratchet-type switches are well known. In the present application, ratchet switch 24 is of a type and is arranged so that the first up and down motion of handle 21 turns lamp 31 on and handle 21 is left in the normal down position shown in solid lines in FIG. 2. The next up and down motion of handle 21 turns lamp 31 on to an increased wattage. The third up and down motion of handle 21 turns lamp 31 on to its highest wattage and the fourth up and down motion of the handle 21 turns lamp 31 off. Handle 21 in this embodiment and mode of operation is always allowed to be left in a normal down position irrespective of whether lamp 31 is on, off or operating at one of the selected wattages.

A single wattage lamp may, of course, be used within the mentioned three-way ratchet switch 24. With this arrangement, the pump handle 21 would be raised and lowered twice to turn the lamp 31 on and raised and lowered twice to turn the lamp 31 off. Thus, the old-fashioned pumping action would be simulated when employing either three wattage or single wattage lamps within the ratchet switch 24.

Also, while not illustrated, it is also recognized that a two-position push button switch could be substituted for the ratchet-type switch 24 and arranged so that it is in an on position when lever 21 is in the solid line position of FIG. 2 and in an off position when lever 21 is in the dotted line position of FIG. 2.

Thus, it can be seen that the nostalgia and hand pumping action associated with the old-fashioned hand pump has been preserved and a useful lamp for conventional application is provided.

What is claimed is:

1. A novelty lamp comprising:

(a) a base member;

(b) a pump housing rigidly secured to said base member;

(c) a pump rod having a portion thereof extending above and vertically movable within said housing;

(d) a pump handle pivotally secured at one end to the top of said pump rod and having intermediate the length thereof a pivotal support on said housing;

(e) a light bulb, shade and support arrangement secured above and to a top portion of said housing and including a tubular support portion containing wiring for energizing said bulb;

(f) a switch mounted in an interior base portion of said housing and having a vertically positionable actuator in vertical alignment with said pump rod's path of vertical movement enabling the lower end of said pump rod to engage and be released from said actuator to control selective positioning of said switch; and (g) an electrical supply cord having a wall outlet plug at one end and connected through said switch to said wiring connected to said bulb thereby enabling said bulb to be energized through circuitry established by positioning of said switch actuator through an up and down pump-like motion of said handle.

2. A novelty lamp as claimed in claim 1 wherein said bulb is a three-way wattage type light bulb and said switch comprises a three-way ratchet-type switch enabling said bulb to be selectively energized to any of three wattages by successive pump-like motions of said handle.

3. A novelty lamp as claimed in claim 1 wherein said switch comprises a ratchet-type switch adapted such that said handle remains in a down position for all operative positions of the switch.

4. A novelty lamp as claimed in claim 1 wherein said switch comprises a two-position switch having open and closed positions achieved by moving said handle in opposite directions.

* * * * *